US005639226A

United States Patent [19]

Boutrup et al.

[11] Patent Number: 5,639,226

[45] Date of Patent: Jun. 17, 1997

[54] PORTABLE, BATTERY OPERATED AIR PUMP

[76] Inventors: Morten Boutrup, Opkaersvej 6, DK-8381 Mundelstrup; Peter Eglund Sorensen, Jegstrupvaenget 539, DK-8310 Tranbjerg, both of Denmark

[21] Appl. No.: 522,258

[22] PCT Filed: Mar. 9, 1994

[86] PCT No.: PCT/DK94/00103

§ 371 Date: Jan. 22, 1996

§ 102(e) Date: Jan. 22, 1996

[87] PCT Pub. No.: WO94/20755

PCT Pub. Date: Sep. 15, 1994

[30] Foreign Application Priority Data

Mar. 9, 1993 [DK] Denmark ..... 0261

[51] Int. Cl.[6] ..... F04B 35/04; F04B 53/16

[52] U.S. Cl. ..... 417/411; 417/234; 417/415; 417/462; 74/49

[58] Field of Search ..... 417/234, 410.1, 417/411, 415, 462; 74/49

[56] References Cited

U.S. PATENT DOCUMENTS

| | | | |
|---|---|---|---|
| 882,099 | 3/1908 | Daffrin | 417/464 |
| 1,224,849 | 5/1917 | Butler et al. | 417/234 |
| 1,414,573 | 5/1922 | Krehlik | 417/464 |
| 4,874,296 | 10/1989 | Moynihan . | |
| 5,127,808 | 7/1992 | Nichols et al. | 417/411 |

FOREIGN PATENT DOCUMENTS

| | | | |
|---|---|---|---|
| 4223708 | 1/1994 | U.S.S.R. | 417/411 |

*Primary Examiner*—Timothy Thorpe
*Assistant Examiner*—Roland G. McAndrews, Jr.
*Attorney, Agent, or Firm*—Frost & Jacobs

[57] ABSTRACT

A portable, battery operated air pump comprising a battery power supply, an electric motor having a drive shaft, a drive wheel affixed to the motor shaft, a driven wheel mounted on a pivot pin and driven by the drive wheel, a cylinder-piston air pump having a forward end pivotally affixed to a pivot pin and a piston rod actuable by the driven wheel, and a nozzle connected to the cylinder and configured for engagement with an air valve of an inflatable object. The above-noted elements are arranged end-to-end in the order given. The pump has a longitudinal axis. The motor shaft has an axis parallel to the pump axis. The driven wheel pivot pin and the cylinder pivot pin having axes perpendicular to the pump longitudinal axis. The overall structure is extremely compact and can be operated by a single hand of the user.

11 Claims, 3 Drawing Sheets

PORTABLE, BATTERY OPERATED AIR PUMP

TECHNICAL FIELD

The present invention relates to a portable, battery operated air pump, preferably for bicycles, and comprising a battery power supply for a motor which, through a wheel assembly, activates a pump mechanism which is connected to an air nozzle intended for engagement with an air valve in the object to be inflated.

BACKGROUND ART

A desire exists for a pump of the above-mentioned type which is compact and which may be brought on bicycles, on camping trips and for other purposes. Pumps of the above type are known from e.g. U.S. Pat. No. 5,127,808. Even though this known pump is rather compact and is able to be brought for use independent of an external power supply, it has a radial dimension which is relatively large. Thus the orientation of the toothed wheel about an axis being parallel with the longitudinal axis of the pump contributes to the relatively large radial dimension of the pump. Moreover, the pump is disadvantageous in that it is rather complicated and consists of a large number of specialized individual parts. Moreover, the pump is disadvantageous as it may not be used for one hand operation. Thus the nozzle is affixed to the compressor of the pump through a flexible air hose.

DISCLOSURE OF THE INVENTION

It is the object of the present invention to provide a pump of the above-mentioned type and which overcomes the disadvantages associated with the known pump, in that it is made of mechanically simple elements and may be operated by one hand only.

According to the present invention this is obtained with a pump characterized in that the elements are arranged end to end in order to provide an elongated flat unit having a tapering end. The pump mechanism consists of a cylinder/piston pump which is pivotally supported in the tapering end and the end of the cylinder is arranged opposite the piston rod. The piston pump is arranged for pivoting around a pivot axis extending substantially perpendicular to a longitudinal axis through the air pump. The nozzle is mounted directly onto the cylinder and is concentric about said pivot axis. The piston rod is rotatably supported near the circumference of a driven wheel which rotates about an axis parallel with the pivot axis and which, together with a small driving wheel, constitute the above-noted wheel assembly. The pinion rotates about an axis parallel to the longitudinal axis of the pump.

Since the elements constitute an elongated and preferably tapering unit, the nozzle arranged at the tapering end may easily be brought into contact with an air valve, e.g. for a wheel on a bicycle. The pump may be held and activated by one hand. The switching means of the pump will preferably be intended for operation by the user's thumb which simultaneously presses the nozzle against the valve. The cylinder/piston pump is a mechanically simple and inexpensive unit. As the cylinder is pivotally supported about an axis being common with the nozzle, it is possible to make the tapering end very narrow whereby the use is made easier. Moreover, the structure is mechanically simple, as it is possible optionally to affix the nozzle directly onto the cylinder or on a housing in which the elements of the pump are contained. The limited pivotal rotation of the nozzle will be absorbed either by a rubber sleeve in the nozzle or by a flexible tube connecting the nozzle and the cylinder.

The use of a connecting rod type movement, which is established by the activation of the piston rod by the rotating driven wheel, is mechanically simple and reliable. Advantageously, the wheel assembly may consist of toothed wheels, however, it may also consist of friction wheels 10*a* and 13*a* (See FIG. 5). When toothed wheels are used they might be of the type which function according to the principle as a crown wheel and a driving pinion. At the backside of the driven wheel it is possible, with due regard to the stability, to arrange a roller opposite the driving friction wheel or the driving pinion.

BRIEF DESCRIPTION OF THE DRAWINGS

Other embodiments will occur from the independent claims. The invention will now be further explained with due regard to the accompanying drawings, in which:

Figure 1:
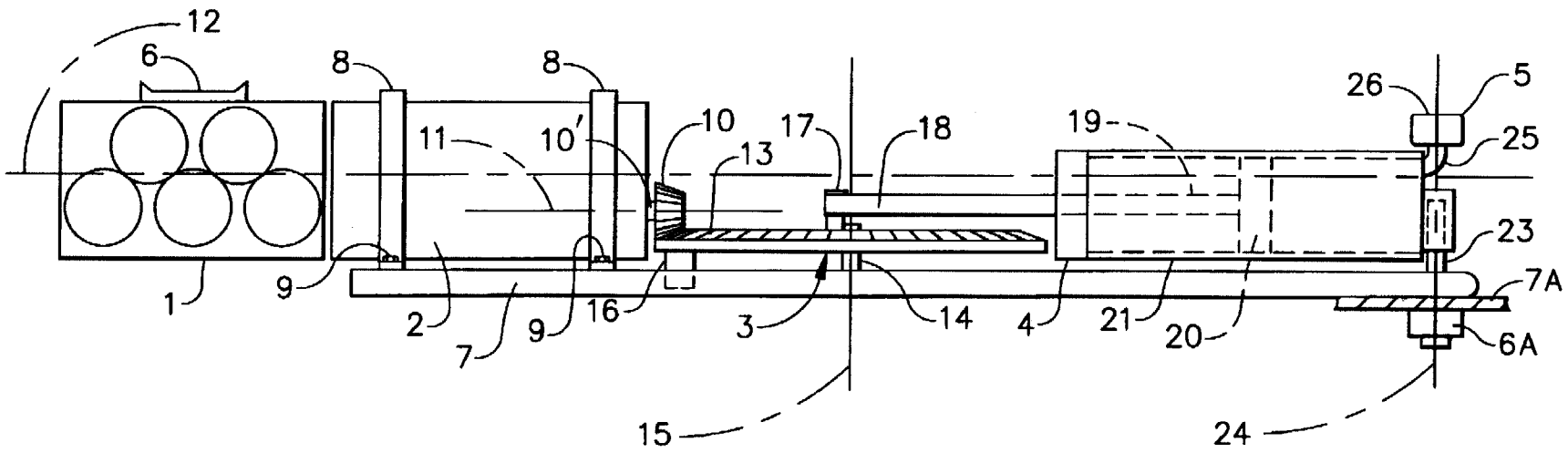
FIG. 1 is a side elevational view of a pump according to the present invention, with its housing removed.
Figure 2:
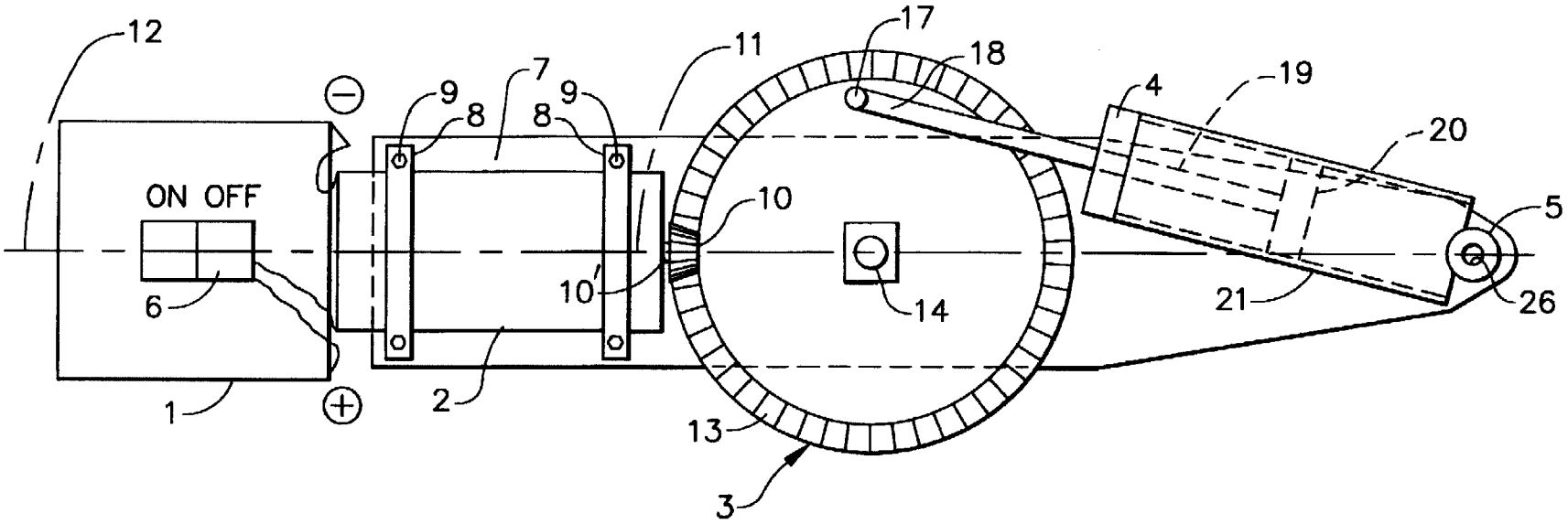
FIG. 2 is a plan view of the structure of FIG. 1.

The Figures show a battery 1, a motor 2, a wheel assembly 3, a cylinder/piston pump 4, and a nozzle 5. For the sake of clarity, a housing for the pump has been omitted.

An on-off switch 6 is, for the sake of convenience, shown in a position in the vicinity of the battery 1. In practice it is preferred to arrange two switches, viz. a spring loaded switch 6*a* and the on-off switch 6 (See FIG. 1.) at the side of the housing in a position opposite the nozzle 5 and being arranged for activation by the user's thumb. The user would simultaneously use the thumb to press the nozzle 5 against an air valve.

The elements 2, 3, 4 and 5 are mounted on a common base plate 7. For stability this base plate 7 may be manufactured from profiled aluminum. The battery 1 may be arranged loosely in the housing of the pump, or it may be affixed to the base plate 7. The motor 2 is affixed to the base plate 7 through two straps 8 and nuts 9. A toothed driving wheel 10 is mounted on a motor shaft 10 and rotates about an axis 11 extending substantially parallel to the longitudinal axis 12 of the pump. The toothed driving wheel 10 drives a second toothed wheel 13 which in principle corresponds to a crown wheel, whereas the toothed driving wheel 10 corresponds to a driving pinion. The driven wheel 13 is supported on a pin 14 which is affixed to the base plate 7 in order to rotate about an axis 15 extending perpendicular to the longitudinal axis 12 of the pump. The driven wheel 13 and The driving wheel 10 constitute the wheel assembly 3 of the pump.

Figure 4:
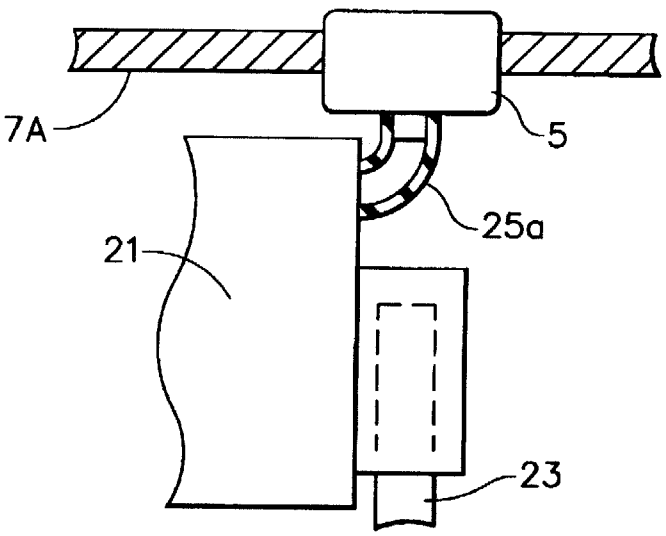
FIG. 4 is a fragmentary view, partly in cross-section, illustrating the nozzle of the present invention affixed to the housing and connected to the cylinder by a flexible tube.
Figure 3:
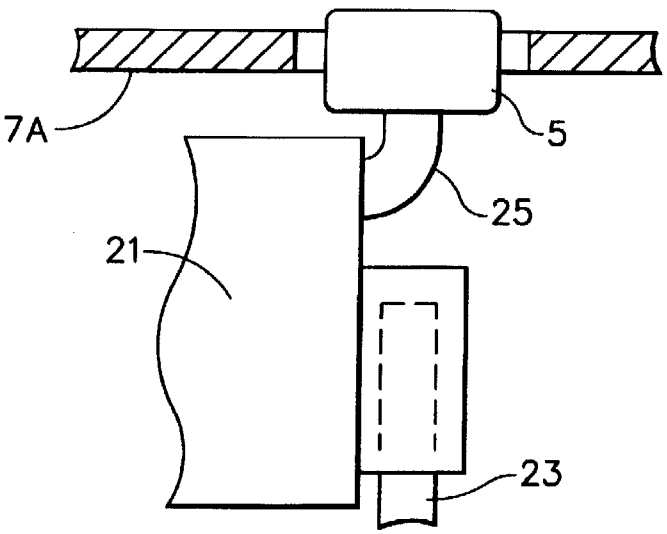
FIG. 3 is a fragmentary view illustrating the nozzle of the present invention fixedly connected to the cylinder.
Figure 5:
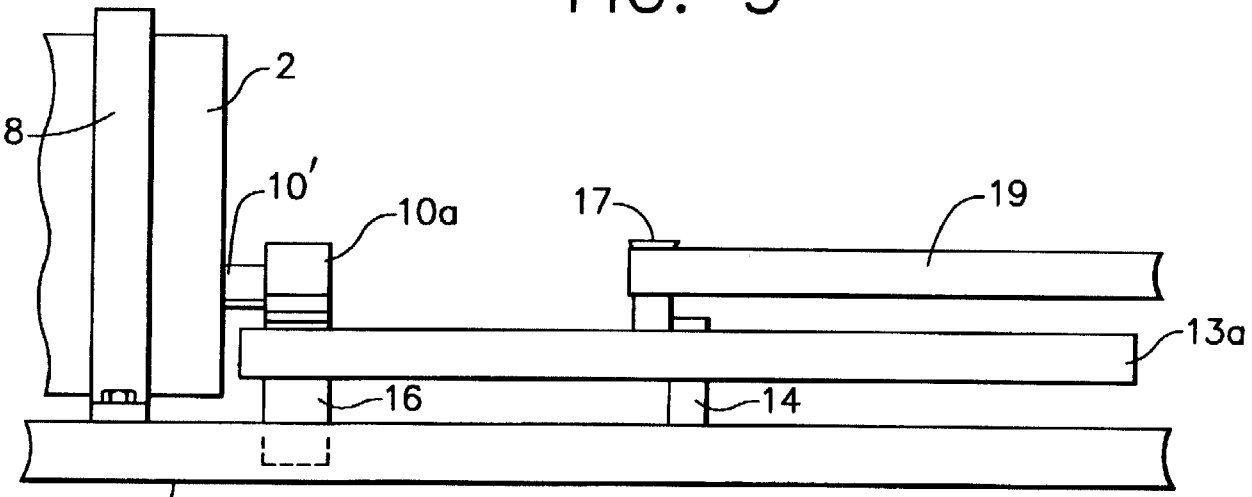
FIG. 5 is a fragmentary elevational view illustrating the driving wheel and the driven wheel in the form of friction wheels.

A support roller 16 is arranged at the backside of the driven wheel 13 in order to ensure that said wheel is not driven awry. The support roller may be made of rubber. It is possible to arrange a number of evenly distributed support rollers in order to provide the best possible support for driven wheel 13. A pivot pin 17 is arranged on the driven wheel 13 in the vicinity of the circumference thereof in order to support one end 18 of a piston rod 19, which at the other end supports a piston 20. The piston 20 is arranged in a cylinder 21. At the end opposite the piston rod 19, the cylinder 21 is supported on a pin 23 for pivoting about an axis 24 extending perpendicular to the longitudinal axis 12 of the pump and parallel with the axis of rotation 15 for the driven wheel 13. The nozzle 5 is directly connected to cylinder 21 and is concentric with the pivot axis 24. The connection 25 between the nozzle and the cylinder may be a rigid connection (see FIG. 3), or a flexible connection 25*a* in the form of a rubber tube (see FIG. 4). The small back and forth pivotal movement, which in use will occur between the nozzle 5 and the cooperating air valve, may be absorbed by the connection 25 or by a rubber sleeve arranged in the opening 26 of the nozzle 5. In case a flexible connection 25*a* is used, the nozzle may be firmly mounted in the housing of the pump. In case a rigid connection 25 is used, the nozzle will extend through an opening in the housing of the pump.

The pump, which may be manufactured with very limited outer dimensions, will be manufactured with a very small height in relation to the diameter of the wheel 13, especially due to the arrangement of the driven wheel 13 for rotation about an axis perpendicular to the longitudinal axis of the pump. The diameter of driven wheel 13 will be determining for the width of the pump. In practice the pump may be manufactured with the following exemplary dimensions: the driven wheel 13 having a diameter of between 70 and 90 mm; the cylinder 21 having a length between 60 and 80 mm and a diameter of between 15 and 30 mm, and the pump unit having a total length of between 250 and 300 mm, and a transverse dimension of between 80 and 100 mm, and a height of between 40 and 60 mm.

In use the motor 2, upon activation of the switch 6 or 6*a*, if present, drives the driving wheel 10 which drives the driven wheel 13. As a result, the cylinder/piston pump 4 is driven through a connecting rod movement displacing the piston 20 in the cylinder 21 in order to create an overpressure inside the cylinder 21. The pump may be held in one hand and the nozzle 5 is pressed against an air valve either by the user's thumb or simply by pressing the pump unit against the air valve.

We claim:

1. A portable, battery operated air pump unit, comprising a battery power supply, a motor connected to said power supply, a wheel assembly driven by said motor, a pump mechanism actuated by said wheel assembly and an air nozzle connected to said pump mechanism and intended for engagement with an air valve in the object to be inflated, characterized in that the elements are arranged end to end in order to provide an elongated flat air pump unit having a tapering forward end, said pump mechanism comprising a cylinder/piston pump having a rearward end and a forward end which is pivotally supported in said tapering forward end of said air pump unit, a piston rod extending from said rearward end of said cylinder/piston pump, said cylinder/piston pump being arranged for pivoting about a pivot axis extending substantially perpendicular to the longitudinal axis of the air pump unit, said nozzle being operatively connected to said pump mechanism cylinder and extending about said cylinder/piston pump pivot axis, said wheel assembly comprising a driven wheel which rotates around an axis parallel to said cylinder/piston pump pivot axis and a driving wheel which engages said driven wheel and which rotates around an axis parallel to said longitudinal axis of said air pump unit, and said piston rod having a free end rotatably supported on said driven wheel adjacent the peripheral edge thereof.

2. The air pump unit according to claim 1, characterized in that said wheel assembly comprises two toothed wheels working according to the principle of a crown wheel and a driving pinion, and a support roller being arranged on the backside of said crown wheel in a position opposite said driving pinion.

3. The air pump unit according to claim 2, characterized in that said support roller is a rubber roller.

4. The air pump unit according to claim 1, characterized in that said motor, said driven wheel and said cylinder/piston pump are mounted on a common base plate.

5. The air pump unit according to claim 1, characterized by a housing for said air pump unit, said nozzle being fixed in said housing and being connected to said air pump unit cylinder by a flexible tube.

6. The air pump unit according to claim 1, characterized by a housing for said air pump unit, said nozzle being fixed to said air pump unit cylinder and being rotatable in relation to said housing.

7. The air pump unit according to claim 1, characterized in that said driven wheel has a diameter of between 70 and 90 mm, that said air pump unit cylinder has a length of between 60 and 80 mm and a diameter of between 15 and 30 mm, that said pump mechanism has a total length of between 250 and 300 mm and a transverse dimension of between 80 and 100 mm and a height of between 40 and 60 mm.

8. The air pump unit according to claim 1, characterized in that said battery power supply is re-chargeable.

9. The air pump unit according to claim 1, characterized in that the pump unit may be activated by means of two different switches, one switch being arranged for continuous actuation to power said motor, and the other switch is of the type which alternatingly switches on and off the circuit for supplying power to said motor.

10. The air pump unit according to claim 1, characterized in that the wheel assembly is constituted by a driving friction wheel and a driven friction wheel.

11. The air pump unit according to claim 1, characterized in that the wheel assembly is constituted by a driving friction wheel and a driven friction wheel.

* * * * *

UNITED STATES PATENT AND TRADEMARK OFFICE

CERTIFICATE OF CORRECTION

PATENT NO. : 5,639,226

DATED : June 17, 1997

INVENTOR(S) : Morten Boutrup and Peter Eglund Sorensen

It is certified that error appears in the above-indentified patent and that said Letters Patent is hereby corrected as shown below:

Column 4, line 50 (claim 11), delete "11. The air pump unit according to claim 1, characterized in that the wheel assembly is constituted by a driving friction wheel and a driven friction wheel." and insert therefor --11. The air pump unit claimed in claim 4 characterized in that said baseplate comprises a profiled aluminum plate.--

Signed and Sealed this

Seventh Day of October, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,639,226

DATED : June 17, 1997

INVENTOR(S) : Morten Boutrup & Peter Egelund Sorensen

It is certified that error appears in the above-indentified patent and that said Letters Patent is hereby corrected as shown below:

ON THE TITLE PAGE:

[76] Inventors: "Peter Eglund Sorensen" should read --Peter Egelund Sorensen--

Signed and Sealed this

Fourteenth Day of April, 1998

Bruce Lehman

*Attest:*

BRUCE LEHMAN

*Attesting Officer*

*Commissioner of Patents and Trademarks*